US010309073B1

(12) United States Patent
Beck

(10) Patent No.: US 10,309,073 B1
(45) Date of Patent: Jun. 4, 2019

(54) SYSTEM AND METHOD FOR ENHANCING STRUCTURAL PERFORMANCE OF DEEP FOUNDATION PILE MEMBERS

(71) Applicant: Gary Eugene Beck, Houston, TX (US)

(72) Inventor: Gary Eugene Beck, Houston, TX (US)

( * ) Notice: Subject to any disclaimer, the term of this patent is extended or adjusted under 35 U.S.C. 154(b) by 0 days.

(21) Appl. No.: 15/807,316

(22) Filed: Nov. 8, 2017

Related U.S. Application Data

(60) Provisional application No. 62/419,560, filed on Nov. 9, 2016.

(51) Int. Cl.

| | |
|---|---|
| ***E02D 5/44*** | (2006.01) |
| ***E02D 5/54*** | (2006.01) |
| ***E02D 5/36*** | (2006.01) |
| ***E02D 27/14*** | (2006.01) |
| ***E02D 27/12*** | (2006.01) |

(52) U.S. Cl.
CPC ..... *E02D 5/54* (2013.01); *E02D 5/36* (2013.01); *E02D 5/44* (2013.01); *E02D 27/12* (2013.01); *E02D 27/14* (2013.01); *E02D 2250/0007* (2013.01); *E02D 2250/0023* (2013.01); *E02D 2300/002* (2013.01)

(58) Field of Classification Search
CPC ..... E02D 27/12
USPC ..... 405/231, 232
See application file for complete search history.

(56) References Cited

U.S. PATENT DOCUMENTS 5,096,333 A * 3/1992 Bassett ..... E02D 35/00 405/244

FOREIGN PATENT DOCUMENTS

| | | | |
|---|---|---|---|
| GB | 469716 | * | 7/1937 |
| GB | 713362 | * | 8/1954 |
| JP | 05287737 | * | 11/1993 |

* cited by examiner

*Primary Examiner* — Sean D Andrish
(74) *Attorney, Agent, or Firm* — Plager Schack LLP

(57) ABSTRACT

A system and method to enhance the structural performance of a reinforced concrete pile in a ground hole is provided. The ground hole includes an upper shaft cavity connected to a lower bell-shaped cavity. The concrete pile includes a cage assembly disposed within the hole in the ground surface and includes a plurality of rebars coupled together by a plurality of fixtures. Each fixture has a generally hexagonal sheet with a plurality of fingers connected to the sheet at corner junctions with each having a concave edge. Each rebar is designed to secure within the concave edges of the corner junctions of the plurality of fixtures. Concrete is disposed within the ground hole to secure the cage assembly therein, thereby enhancing the structural performance of the reinforced concrete pile by minimizing shear stress failure and enhancing load-bearing capacity of the pile.

8 Claims, 10 Drawing Sheets

SYSTEM AND METHOD FOR ENHANCING STRUCTURAL PERFORMANCE OF DEEP FOUNDATION PILE MEMBERS

RELATED APPLICATION

The application claims priority to provisional patent application U.S. Ser. No. 62/419,560 filed on Nov. 9, 2016, the entire contents of which is herein incorporated by reference.

BACKGROUND

The embodiments herein relate generally to deep foundation pile members. More specifically, the invention relates to cast-in-drilled hole reinforced concrete piles.

Cast-in-drilled hole reinforced concrete piles with enlarged bases are commonly used foundations to support houses, buildings, piers, and other structures above the ground. These reinforced concrete piles are formed by digging a hole within the ground to create an upper shaft cavity connected to a larger lower bell-shaped base cavity. These types of piles, also known as Bell-Bottomed Pier Deep Foundations are formed by inserting a cage into the hole comprising a plurality of rebars connected together and disposing concrete into the hole to secure the cage in place.

Current Bell-Bottomed Pier Deep Foundation Piles are structurally inefficient, which results in the need for more pile constructions, concrete, reinforcement members and ultimately labor. This greatly increases the overall construction and/or maintenance costs of the piles. Further, the structural performance of these piles is deficient because the reinforcement members including the rebars are not properly oriented throughout the bottom bell-shaped cavity. As a result, this problematic design results in a greater incidence of shear cone stresses throughout the bottom bell-shaped cavity, which causes premature failure of the pile.

As such, there is a need in the industry for a system and method for enhancing the structural performance of cast-in-drilled hole reinforced concrete piles formed from an upper shaft cavity connected to a lower bell-shaped cavity within the ground. More specifically, there is a need for the concrete pile to have rebars better distributed throughout the upper shaft cavity and lower bell-shaped cavity to enhance the load-bearing capacity of the pile and reduce failure rates.

SUMMARY

A deep foundation reinforced concrete pile with enhanced structural performance for use in a hole in a ground surface is provided. The hole comprises an upper shaft cavity connected to a lower generally bell-shaped cavity. The deep foundation concrete pile comprises a cage assembly disposed within the hole in the ground surface and comprises a plurality of rebars coupled together by a plurality of fixtures and extending through the upper shaft cavity and the lower bell-shaped cavity, each fixture comprising a generally hexagonal sheet comprising a plurality of fingers extending from an outer edge of the sheet, each finger in the plurality of fingers connected to the hexagonal sheet at a corner junction comprising a concave edge formed by the finger and outer edge of the sheet, the plurality of fixtures oriented so the plurality of fingers of each fixture are aligned with the plurality of fingers in an adjacent fixture in the plurality of fixtures, each rebar in the plurality of rebars configured to be secured within the concave edges of the corner junctions of the plurality of fixtures, and concrete disposed within the hole in the ground to secure the cage assembly therein, thereby enhancing the structural performance of the reinforced concrete pile by minimizing shear stress failure and enhancing load-bearing capacity of the pile.

In certain embodiments, each fixture in the plurality of fixtures comprises a central opening, the central opening comprising an edge with a plurality of inner hooks, each rebar in the plurality of rebars configured to be secured within the inner hooks of the plurality of fixtures.

In certain embodiments of the invention, a method to enhance structural performance of a deep foundation reinforced concrete pile in a hole in a ground surface is provided. The method comprises providing a cage assembly, disposing the cage assembly into the hole so the upper handle sections of the rebars remain above the ground surface, the neck sections of the rebars extend within the upper shaft cavity of the hole, and the lower bent sections of the rebars extend within the lower bell-shaped cavity, rotating the upper handle sections of the rebars to permit the lower bent sections of the rebars to extend outward into space within the bell-shaped cavity of the hole, and disposing concrete into the upper shaft cavity and lower bell-shaped cavity of the hole.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
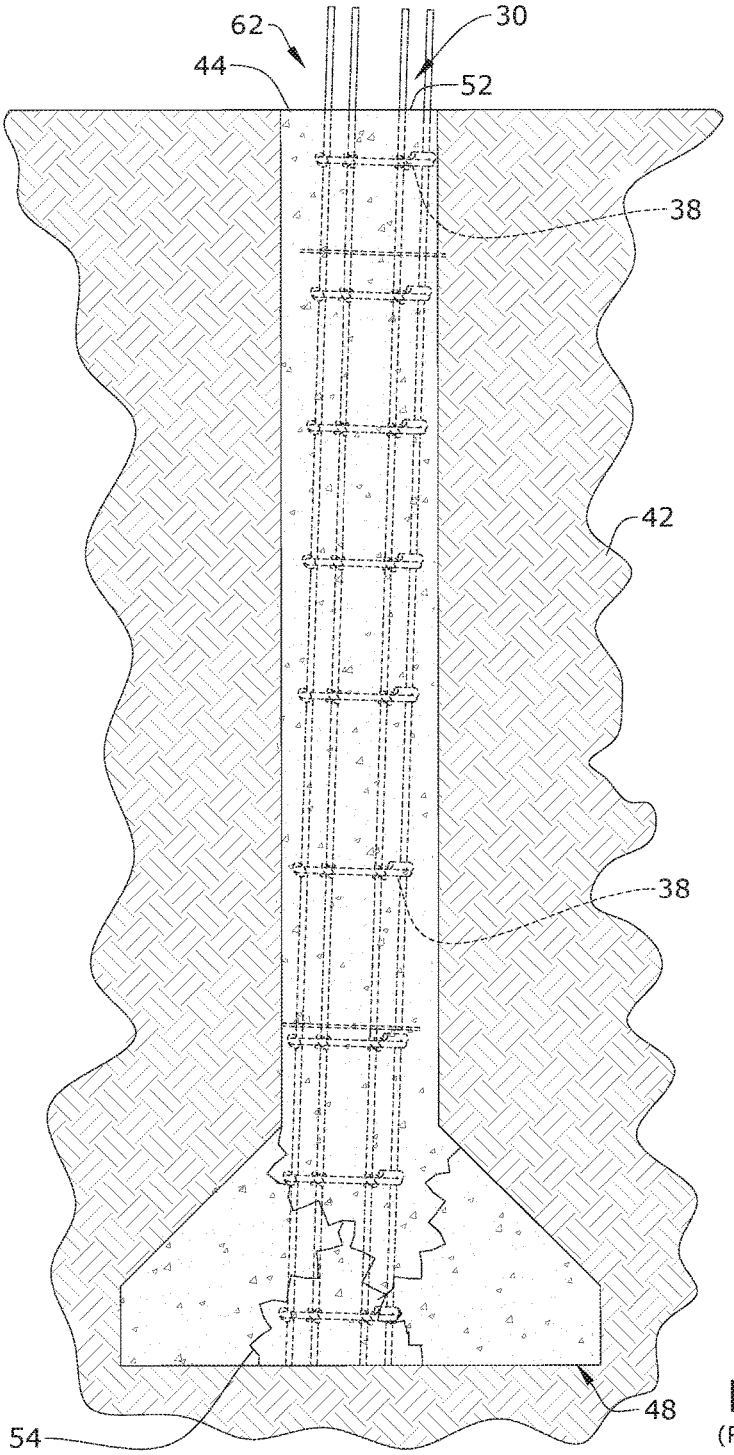
FIG.1 (PRIOR ART)
FIG. 1 depicts a section view of a reinforced concrete deep foundation pile in the prior art.

As depicted in FIG. 1, a cast-in-drilled hole reinforced concrete pile in the prior art is shown, which is configured to support a structure (not shown) above the ground such as a pier, house or other building. The prior art pile is formed within ground 42 of the earth in a hole comprising upper shaft cavity 44 connected to a lower bell-shaped cavity 48. In one exemplary configuration, upper shaft cavity 44 comprises a diameter of approximately 12" and lower bell-shaped cavity 48 comprises a diameter of approximately 36". However, the dimensions of the cavity may vary. The pile is constructed by disposing prior art cage assembly 62 into the cavity in ground 42.

Cage assembly 62 comprises a plurality of non-formed rebars 30 coupled together by horizontal cages 38. Concrete 52 is disposed into upper shaft cavity 44 and lower bell-shaped cavity 48 via a pump to secure cage assembly 62 within the cavity. Structural performance of the prior art reinforced concrete pile is deficient due to potential misalignments of the non-formed rebars 30 within upper shaft cavity 44 and the failure of non-formed rebars 30 to extend outward into space within lower bell-shaped cavity 48. This design can be problematic due to the increased potential for shear cone stress failures 54 in the pile when in use.

Figure 9:
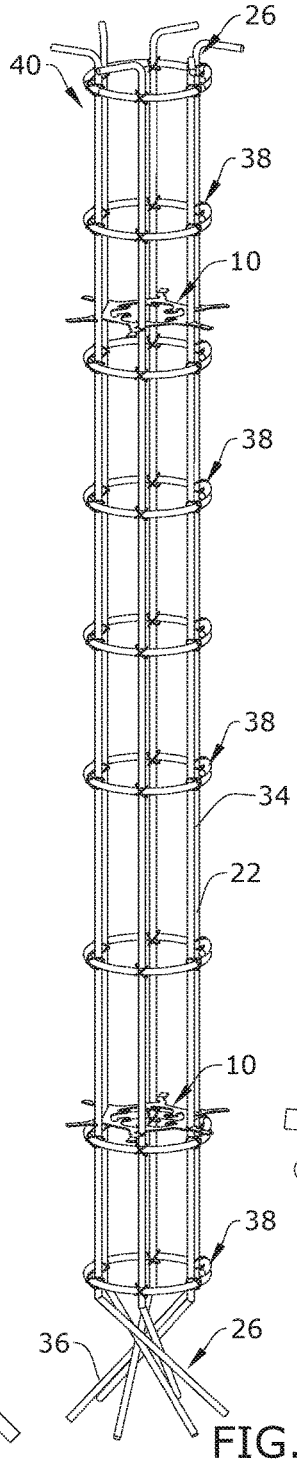
FIG. 9 depicts a perspective view of certain embodiments of the deep foundation pile illustrating a cage assembly.

FIGS. 1-13 and 17 depict certain embodiments of a reinforced concrete pile with enhanced structural performance. The reinforced concrete pile is formed with cage assembly 40, which comprises a plurality of first exemplary rebars 26 coupled together by horizontal cages 38 and cage fixtures 10 as depicted in FIG. 9. It shall be appreciated that at least two cage fixtures 10 and any number of horizontal cages 38 may be used. Depending on the application, the spacing between horizontal cages 38 and spacing between cage fixtures 10 may vary. It shall be appreciated that embodiments of the invention are advantageous because first exemplary rebars 26 comprising a generally higher quantity of smaller rebars are used than is typically applied in the prior art piles.

Figure 2:
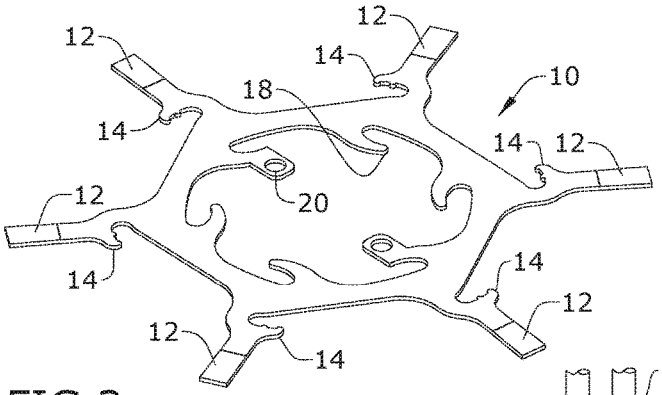
FIG. 2 depicts a perspective view of certain embodiments of the deep foundation pile illustrating a cage fixture.
Figure 3:
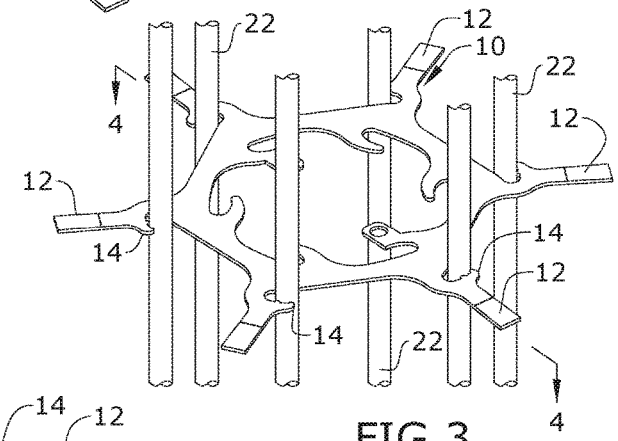
FIG. 3 depicts a perspective view of certain embodiments of the deep foundation pile.
Figure 4:
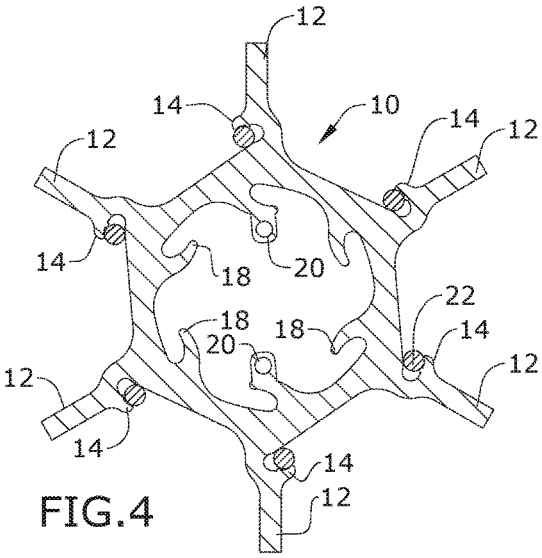
FIG. 4 depicts a section view of certain embodiments of the deep foundation pile taken along line 4-4 in FIG. 3.

As depicted in FIGS. 2-4, each cage fixture 10 comprises a generally hexagonal-shaped sheet with a central opening, outer fingers 14 and inner hooks 18. The hexagonal-shaped sheet may be made from any materials including, but not limited to, steels such as carbon steel or stainless steel, fiberglass, plastic, and the like. In a preferred embodiment, each outer finger 14 is connected to the hexagonal-shaped sheet at a corner junction and comprises foldable tab 12. The corner junction creates an outer hook along a concave edge formed by outer finger 14 and the outer edge of the hexagonal-shaped sheet. Inner hooks 18 are formed along the inner edge along the central opening in the hexagonal-shaped sheet. In one embodiment, each cage fixture 10 comprises visual alignment holes 20.

Cage fixtures 10 are configured to secure the plurality of first exemplary rebars 26 together. In one embodiment, first exemplary rebar 26 is made from #4 rebar 22 as depicted in the top view in FIG. 7 and side view in FIG. 8. Each #4 rebar 22 comprises formed upper handle section 32 continuously connected to formed neck section 34 continuously connected to formed lower bent section 36. As depicted in FIGS. 3-4, formed neck sections 34 of #4 rebars 22 are secured within the outer hooks formed by the concave edges extending from outer fingers 14 to the hexagonal-shaped sheets. In alternative embodiments, it shall be appreciated that each cage fixture 10 may comprise different outer shapes to accommodate a different number of rebars.

Figure 5:
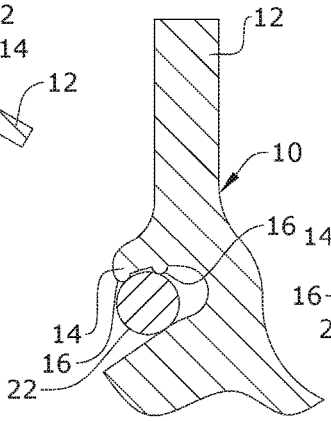
FIG. 5 depicts a section view of certain embodiments of the deep foundation pile.
Figure 6:
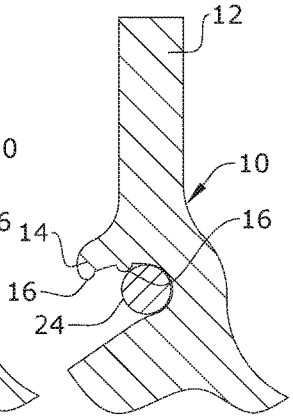
FIG. 6 depicts a section view of certain embodiments of the deep foundation pile.
Figure 7:
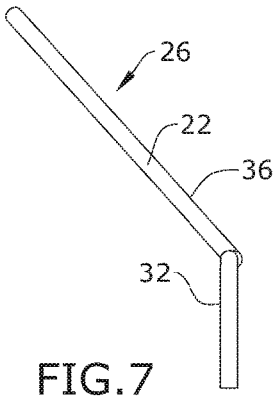
FIG. 7 depicts a top view of certain embodiments of the deep foundation pile illustrating a first exemplary rebar.
Figure 8:
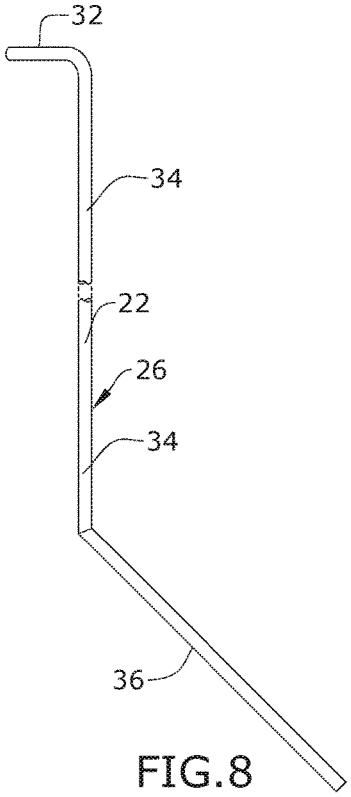
FIG. 8 depicts a side view of certain embodiments of the deep foundation pile illustrating the first exemplary rebar.

In a preferred embodiment, a pair of retaining protrusions 16 extend from the concave edge of each outer finger 14 of cage fixture 10 as depicted in FIG. 5. Retaining protrusions 16 contact the rebar to help secure the member within outer finger 14 of caged fixture 10. FIG. 6 depicts first exemplary rebar 26 using #3 rebar 24 in an alternative placement within outer finger 14 of caged fixture 10. It shall be appreciated that first exemplary rebars 26 can be made from various materials including, but not limited to, steel, reinforced plastic or fiberglass, and may have variable specifications.

Figure 10:
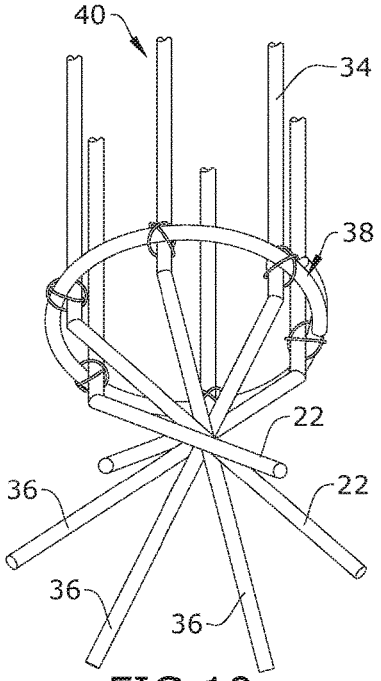
FIG. 10 depicts a bottom perspective view of certain embodiments of the deep foundation pile illustrating the cage assembly.
Figure 11:
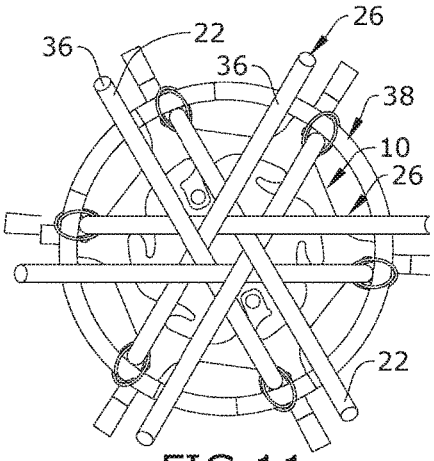
FIG. 11 depicts a bottom view of certain embodiments of the deep foundation pile illustrating the cage assembly.
Figure 12:
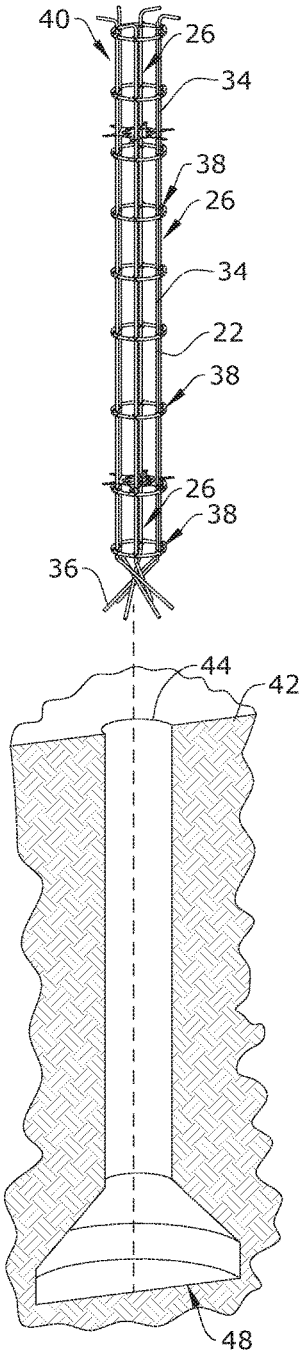
FIG. 12 depicts an exploded view of certain embodiments of the deep foundation pile.
Figure 13:
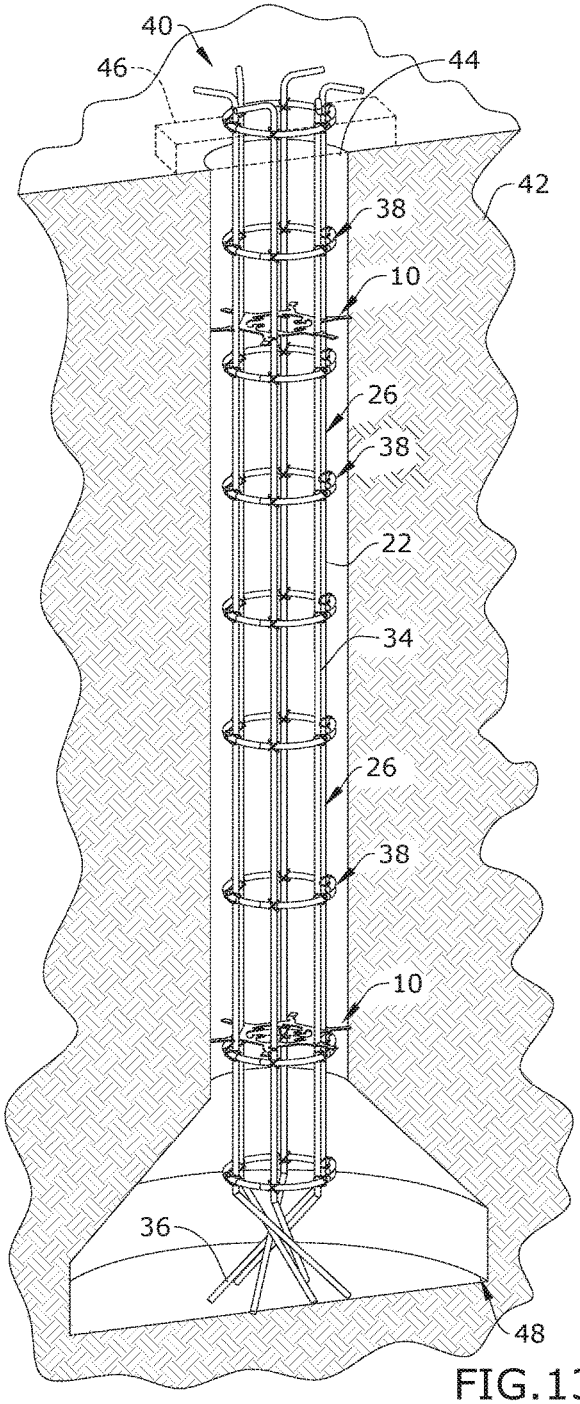
FIG. 13 depicts a perspective view of certain embodiments of the deep foundation pile shown in use.

As depicted in FIGS. 9-11, the assembled cage assembly 40 comprises a plurality of first exemplary rebars 26 coupled together by cage fixtures 10 and horizontal cages 38. Each horizontal cage 38 comprises a ring tied to first exemplary rebars 26 by a plurality of wires. As depicted in FIGS. 12-13, cage assembly 40 is disposed within upper shaft cavity 44 and lower bell-shaped cavity 48 within ground 42. One or more support blocks 46 may be used to stabilize cage assembly 40 during the assembly. In one embodiment, support block 46 is a wooden 2"×4" or 2"×6" block disposed on the ground and in contact with a portion of cage assembly 40 such as an upper horizontal cage 38 to support formed upper handle sections 32 of first exemplary rebars 26 above ground 42. In this configuration, formed lower bent sections 36 of first exemplary rebars 26 are clumped together and bent inward within lower bell-shaped cavity 48 in ground 42.

Figure 14:
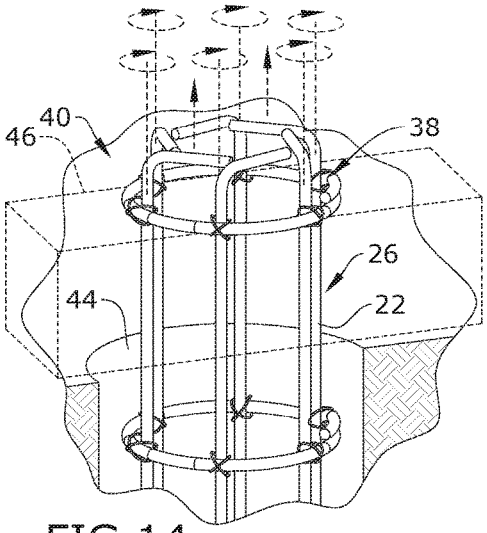
FIG. 14 depicts a perspective view of certain embodiments of the deep foundation pile shown in use illustrating the rotation of the upper handle sections of the rebars.
Figure 16:
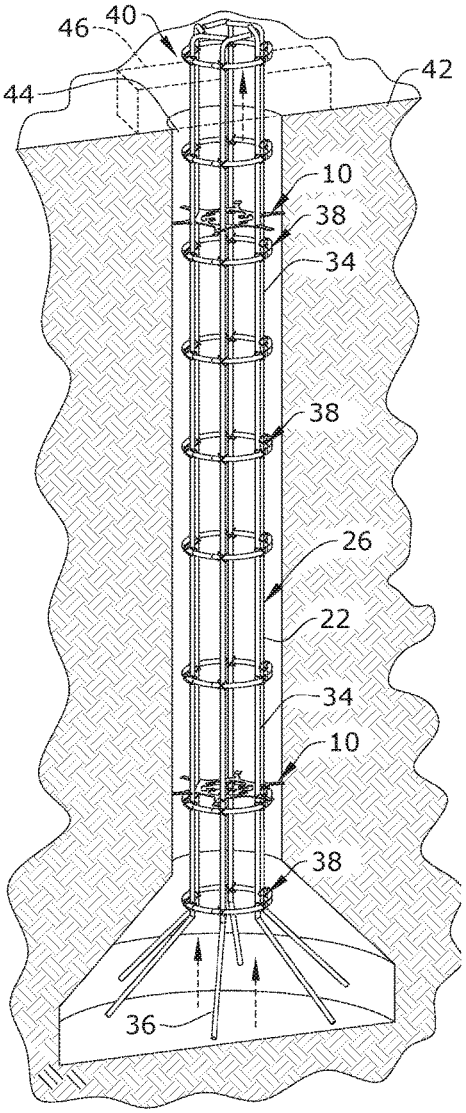
FIG. 16 depicts a perspective view of certain embodiments of the deep foundation pile shown in use.
Figure 15:
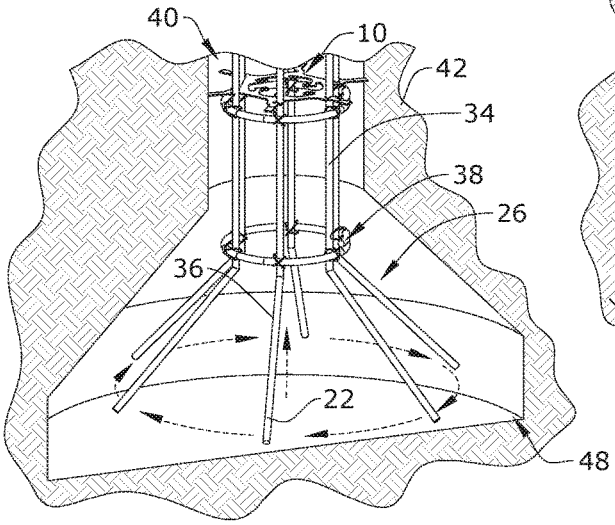
FIG. 15 depicts a bottom perspective view of certain embodiments of the deep foundation pile illustrating the corresponding rotation of the lower bent sections of the rebars.

As depicted in FIGS. 14-16, the one or more support blocks 46 can be manually turned to its side face to lift cage assembly 40 further up above ground 42. This lifts the ends of formed lower bent sections 36 of first exemplary rebars 26 off the bottom of lower bell-shaped cavity 48, thereby permitting the rotation of the rebars with greater ease.

Formed upper handle sections 32 of first exemplary rebars 26 are rotated as shown by the arrows in the figures to permit a corresponding rotation of the formed lower bent sections 36. The rotation of the rebars are performed until lower bent sections 36 of first exemplary rebars 26 extend outward away from each other and into space within lower bell-shaped cavity 48 that was previously unreinforced. Cage fixtures 10 are beneficial because they effectively secure first exemplary rebars 26 in an aligned configuration and permit the rotation of the rebars during the installation of cage assembly 40 in ground 42.

Figure 17:
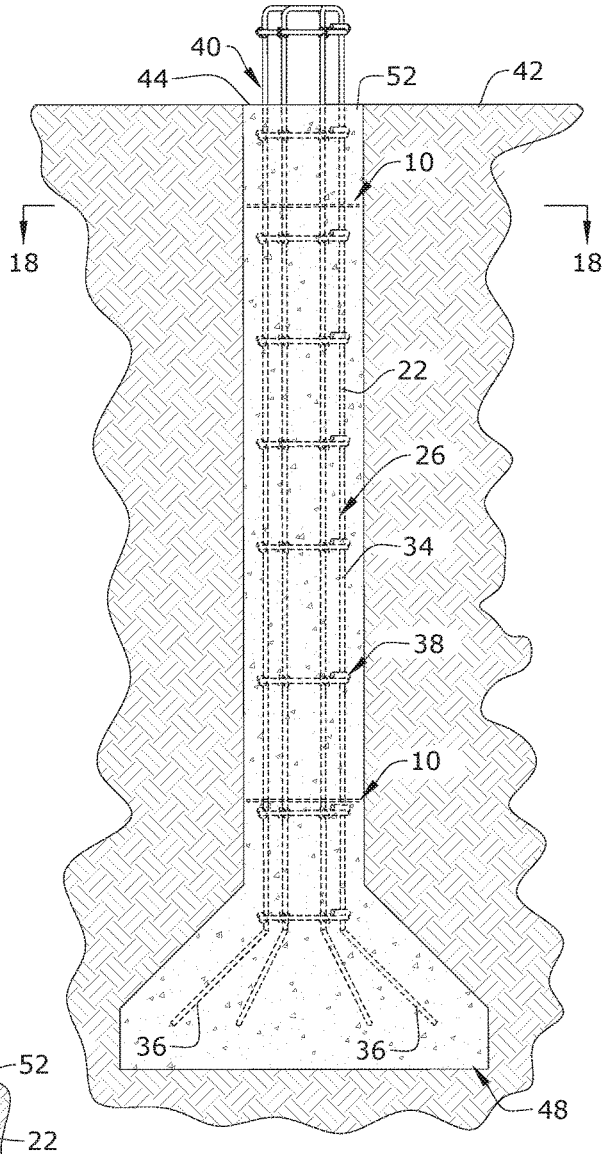
FIG. 17 depicts a section view of certain embodiments of the deep foundation pile shown in use.
Figure 18:
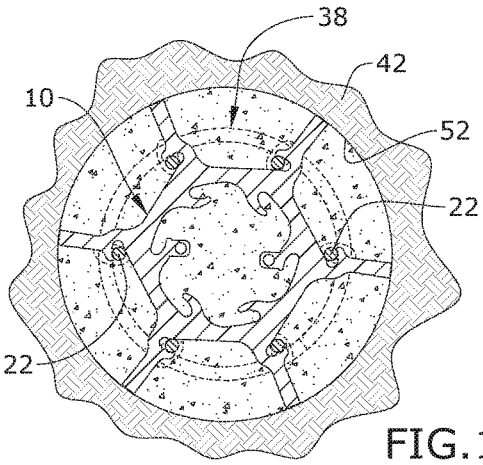
FIG. 18 depicts a section view of certain embodiments of the deep foundation pile taken along line 18-18 in FIG. 17.

As depicted in FIGS. 17-18, concrete 52 is disposed within both upper shaft cavity 44 and lower bell-shaped cavity 48 to secure cage assembly 40 in place within ground 42. In this configuration, the reinforced concrete pile is configured to support a structure disposed thereon above the ground. The structural performance of the reinforced concrete pile is enhanced because formed neck sections 34 of first exemplary rebars 26 are properly aligned throughout upper shaft cavity 44 and formed lower bent sections 36 extend outward and away from each other through the space within lower bell-shaped cavity 48. As a result, the incidence of sheer cone stress failures throughout the pile when in use is greatly reduced.

In an alternative embodiment, first exemplary rebars 26 are coupled within inner hooks 18 of cage assembly 40 as depicted in FIGS. 19-22. In this alternative embodiment, cage assembly 40 is disposed within upper shaft cavity 44 and lower bell-shaped cavity 48, maneuvered and assembled in the same manner as previously described. First exemplary rebars 26 may be secured to inner hooks 18 or outer fingers 14 of cage fixtures 10 to satisfy the particular strength requirements and/or comply with any applicable codes.

Figure 23:
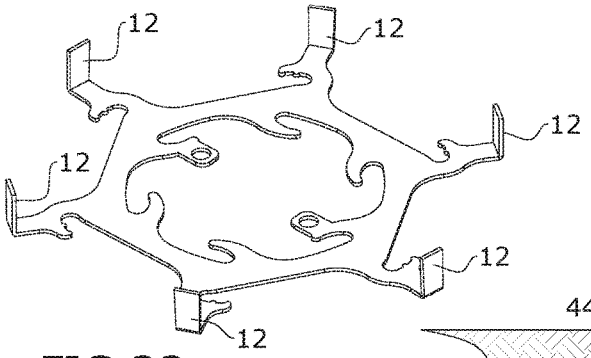
FIG. 23 depicts a perspective view of certain embodiments of the deep foundation pile illustrating the cage fixture in an alternative configuration.
Figure 24:
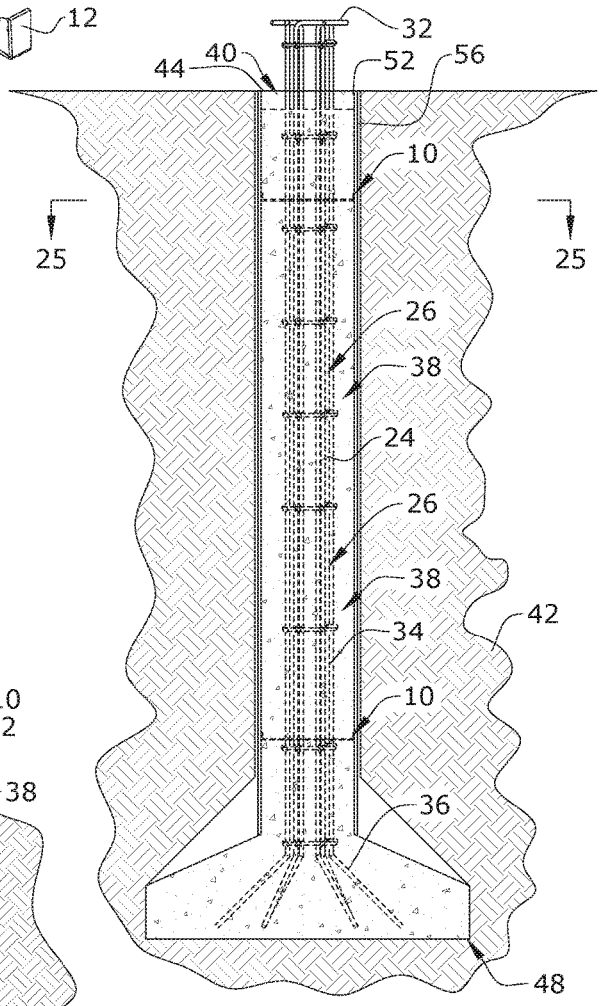
FIG. 24 depicts a section view of certain embodiments of the deep foundation pile shown in use in an alternative configuration.
Figure 25:
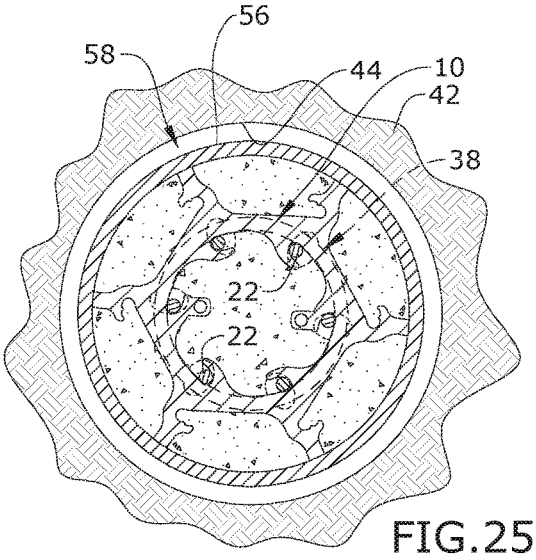
FIG. 25 depicts a section view of certain embodiments of the deep foundation pile taken along line 25-25 in FIG. 24.

FIGS. 23-25 depict an alternative embodiment of the reinforced concrete pile. In this alternative configuration, foldable tabs 12 of each cage fixture 10 are folded up as depicted in FIG. 23. Cage assembly 40 is assembled together using first exemplary rebars 26, cage fixtures 10 and horizontal cages 38 as previously described. Tube 56 is disposed within upper shaft cavity 44 in ground 42 to create air gap 58 as depicted in FIGS. 24-25. In one embodiment, tube 56 comprises an approximate diameter of 10" and is made from any materials such as cardboard. Cage assembly 40 is disposed within upper shaft cavity 44 and lower bell-shaped cavity 48, maneuvered and assembled in the same manner as previously described. In this configuration, foldable tabs 12 may contact tube 56. Concrete 52 is disposed within upper shaft cavity 44 and lower bell-shaped cavity 48 to complete the assembly of the reinforced concrete pile. The primary purpose of tube 56 is to separate concrete 52 from the earth in ground 42.

Foldable tabs 12 of cage fixtures 10 reduce the diameter of cage assembly 40. This reduces the concrete volume when cage assembly 40 is used with tube 56. Tube 56 creates a smoother shaft surface that will have a lower surface friction coefficient. This smooth surface of the pile will better resist soil adhesion that occurs within clayey soil due to soil moisture changes. A soil depth zone called a 'moisture effected zone' is typically estimated to extend nominally 6 to 8 feet below the surface. Expanding soil in this zone can grab and lift a typical rough walled augured pile causing damage and/or foundation distress. By improving the isolation of the reinforced concrete pile from the soil, the pile can be designed to be shorter than a non-isolated pile. In addition, a smaller diameter reinforced concrete pile will provide equal or better structural performance due to a more accurate location of reinforcement rebar closer to the pile shaft wall.

Figure 26:
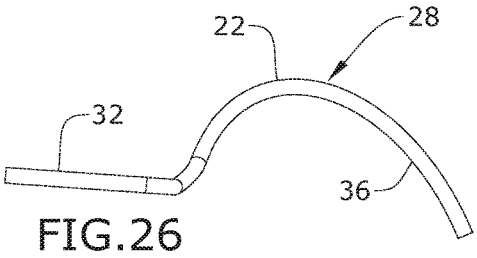
FIG. 26 depicts a top view of certain embodiments of the deep foundation pile illustrating a second exemplary rebar.
Figure 28:
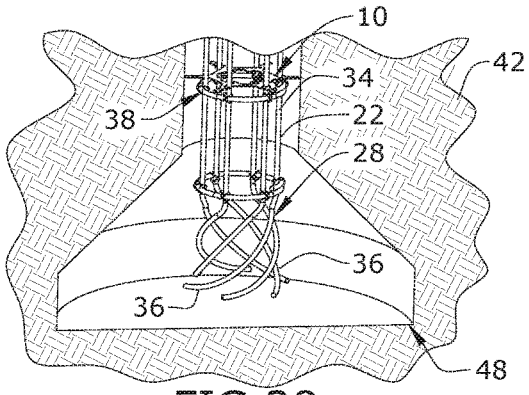
FIG. 28 depicts a perspective view of certain embodiments of the deep foundation pile.
Figure 27:
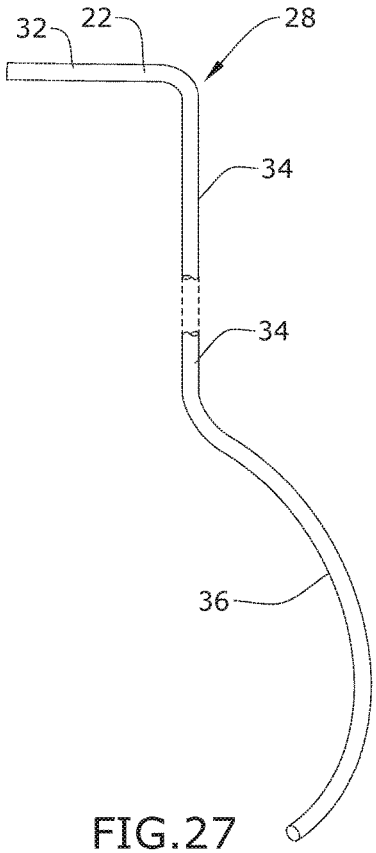
FIG. 27 depicts a side view of certain embodiments of the deep foundation pile illustrating the second exemplary rebar.
Figure 29:
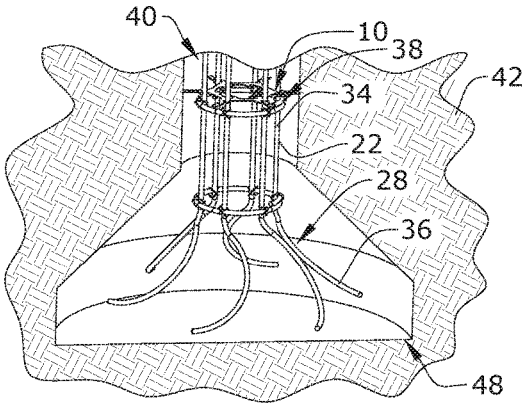
FIG. 29 depicts a perspective view of certain embodiments of the deep foundation pile.
Figure 30:
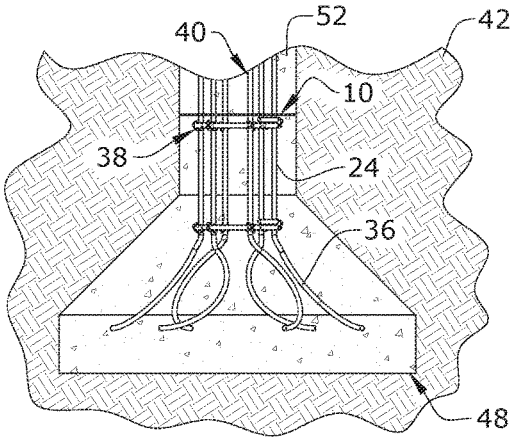
FIG. 30 depicts a section view of certain embodiments of the deep foundation pile.

FIGS. 26-30 depict an alternative embodiment of the reinforced concrete pile with cage assembly 40 formed by second exemplary rebars 28. Second exemplary rebars 28 are coupled together by horizontal cages 38 and cage fixtures 10 as previously discussed. FIG. 26 depicts a top view of second exemplary rebar 28 and FIG. 27 depicts a side view of second exemplary rebar 28. Each second exemplary rebar 28 comprises formed upper handle section 32 continuously connected to formed neck section 34 continuously connected to formed lower bent section 36, which comprises a curvature. As depicted in FIGS. 28-30, cage assembly 40 is disposed within upper shaft cavity 44 and lower bell-shaped cavity 48, maneuvered and assembled in the same manner as previously described. Concrete 52 is disposed within upper shaft cavity 44 and lower bell-shaped cavity 48 to complete the assembly of the reinforced concrete pile. In this alternative embodiment, the curvature of formed lower bent sections 36 extend outward and away from each other through the space within lower bell-shaped cavity 48.

In certain embodiments of the invention, a method to enhance structural performance of a cast-in-drilled hole reinforced concrete pile is provided. The method comprises one or more of the following steps.

Figure 19:
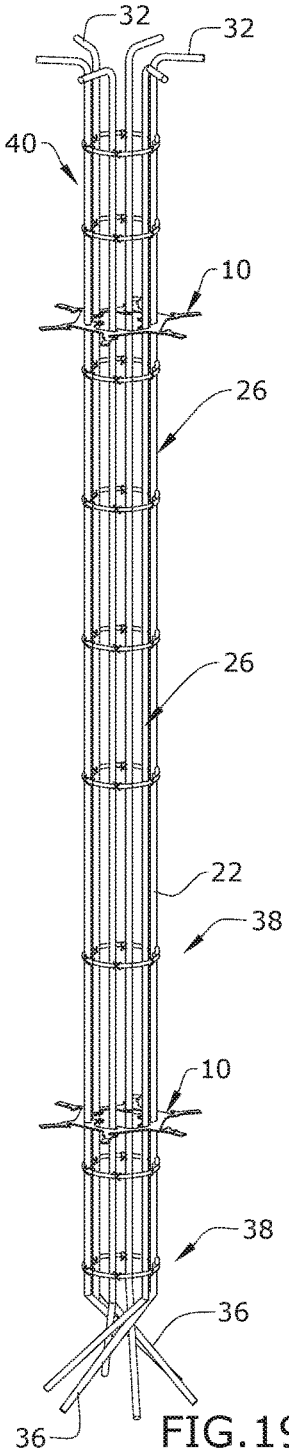
FIG. 19 depicts a perspective view of certain embodiments of the deep foundation pile in an alternative configuration.
Figure 20:
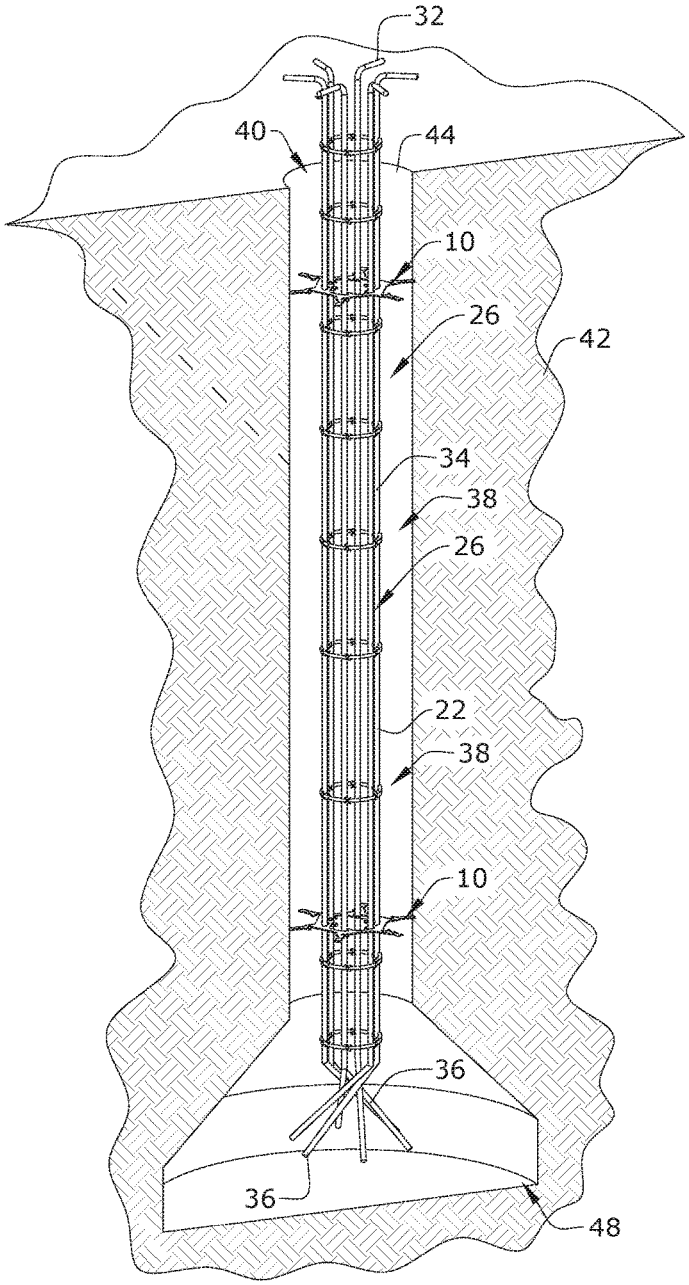
FIG. 20 depicts a perspective view of certain embodiments of the deep foundation pile illustrating the alternative configuration in use.
Figure 21:
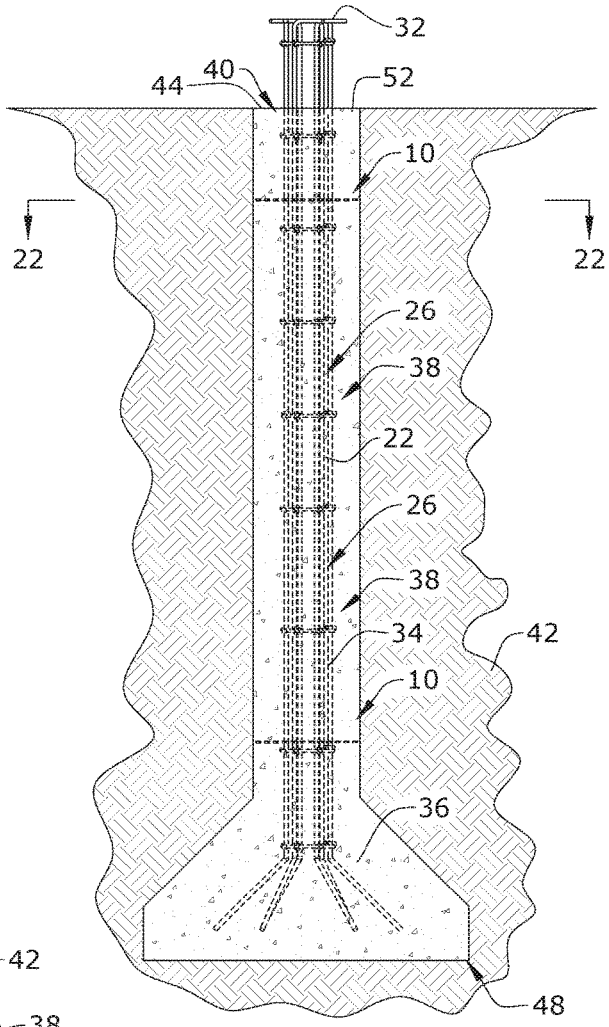
FIG. 21 depicts a section view of certain embodiments of the deep foundation pile illustrating the alternative configuration in use.
Figure 22:
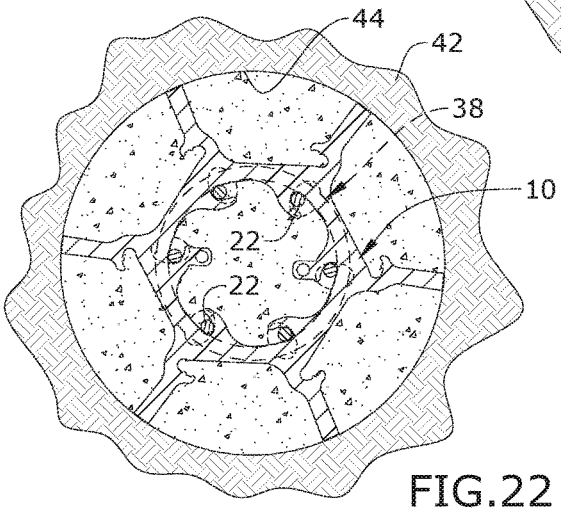
FIG. 22 depicts a section view of certain embodiments of the deep foundation pile taken along line 22-22 in FIG. 21.

First, any cage assembly 40 described in embodiments of the invention is constructed and provided. This is assembled above ground 42 and typically comprises connecting a plurality of first exemplary rebars 26 or second exemplary rebars 28 together using cage fixtures 10 and horizontal cages 38. An individual may use visual alignment holes 20 of cage fixtures 10 to ensure a proper alignment of the fixtures when securing them to first or second exemplary rebars 26, 28. Once assembled, formed bent sections 36 of the rebars are pointed inward and in a closed position as depicted in FIGS. 9, 19 and 28.

Cage assembly 40 is disposed into upper shaft cavity 44 and lower bell-shaped cavity 48 in ground 42 so that formed upper handle sections 32 of the rebars remain above ground 42, formed neck sections 34 of the rebars extend within upper shaft cavity 44 and formed lower bent sections 36 extend within lower bell-shaped cavity 48. This may be performed manually by one or more individuals or by a machine such as a crane. One or more support blocks 46 may be used to stabilize cage assembly 40 during the installation as shown in FIGS. 13-14. In one embodiment, the one or more support blocks 46 are turned on their side faces to lift cage assembly 40 further up above ground 42. This lifts the ends of formed lower bent sections 36 of the rebars off the bottom of lower bell-shaped cavity 48 in ground 42.

Formed upper handle sections 32 of the rebars are rotated either manually by hand or via a tool such as a wrench to permit a corresponding rotation of the formed lower bent sections 36. The rotation of the rebars are performed until lower bent sections 36 of first exemplary rebars 26 or second exemplary rebars 28 extend outward away from each other and into space within lower bell-shaped cavity 48 that was previously unreinforced. Concrete 52 is disposed into upper shaft cavity 44 and lower bell-shaped cavity 48 in ground 42 either manually or via a tool such as a pump. This completes the assembly of the reinforced concrete pile.

In an alternative embodiment, foldable tabs 12 of cage fixtures 10 are folded up during the assembly of cage assembly 40 as depicted in FIGS. 23-25. In this embodiment, tube 56 is disposed within upper shaft cavity 44 in ground 42 to create air gap 58 as depicted in FIGS. 24-25. In this configuration, foldable tabs 12 of cage fixtures 10 may contact tube 56. Air gap 58 can be left open or be back-filled with concrete, cement-sand, other sand mixture, expanding urethane foam, or other filler.

It shall be appreciated that the components of the reinforced concrete pile described in several embodiments herein may comprise any alternative known materials in the field and be of any color, size and/or dimensions. It shall be appreciated that the components of the reinforced concrete pile described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention, the scope of the invention is reflected by the breadth of the claims below rather than narrowed by the embodiments described above.

What is claimed is:

1. A deep foundation reinforced concrete pile with enhanced structural performance for use in a hole in a ground surface, the hole comprising an upper shaft cavity connected to a lower generally bell-shaped cavity, the deep foundation concrete pile comprising:

a cage assembly disposed within the hole in the ground surface, the cage assembly comprising:

a plurality of rebars coupled together by a plurality of fixtures and extending through the upper shaft cavity and the lower bell-shaped cavity, each fixture comprising a sheet comprising a plurality of fingers extending from an outer edge of the sheet, each finger in the plurality of fingers connected to the sheet at a corner junction comprising a concave edge formed by the finger and outer edge of the sheet, each finger in the plurality of fingers comprising a plurality of retaining protrusions on the concave edge of each fixture, the plurality of retaining protrusions configured to contact one of the plurality of rebars secured therein, the plurality of fixtures oriented so the plurality of fingers of each fixture are aligned with the plurality of fingers in an adjacent fixture in the plurality of fixtures, each rebar in the plurality of rebars configured to be secured within the concave edges of the corner junctions of the plurality of fixtures; and concrete disposed within the hole in the ground to secure the cage assembly therein, thereby enhancing the structural performance of the reinforced concrete pile by minimizing shear stress failure and enhancing load-bearing capacity of the pile.

2. The deep foundation concrete pile of claim 1, wherein each rebar in the plurality of rebars comprises an upper handle section positioned above the ground surface continuously connected to a neck section extending through the upper shaft cavity continuously connected to a lower bent section extending outward into space within the bell-shaped cavity of the hole.

3. The deep foundation concrete pile of claim 2, wherein each fixture in the plurality of fixtures comprises a generally hexagonal-shaped sheet with a central opening, the central opening comprising an edge with a plurality of inner hooks, each rebar in the plurality of rebars configured to be secured within the inner hooks of the plurality of fixtures.

4. The deep foundation concrete pile of claim 3, wherein each finger in the plurality of fixtures comprises a foldable tab configured to contact a sleeve disposed in the upper shaft cavity of the hole.

5. A method to enhance structural performance of a deep foundation reinforced concrete pile in a hole in a ground surface, the hole comprising an upper shaft cavity connected to a lower generally bell-shaped cavity, the method comprising:

providing a cage assembly, the cage assembly comprising:

a plurality of rebars coupled together by a plurality of fixtures, each rebar in the plurality of rebars comprising an upper handle section continuously connected to a neck section continuously connected to a lower bent section, each fixture comprising a sheet comprising a plurality of fingers extending from an outer edge of the sheet, each finger in the plurality of fingers connected to the sheet at a corner junction comprising a concave edge formed by the finger and outer edge of the sheet, each finger in the plurality of fingers comprising a plurality of retaining protrusions on the concave edge of each fixture, the plurality of retaining protrusions configured to contact one of the plurality of rebars secured therein, the plurality of fixtures oriented so the plurality of fingers of each fixture are aligned with the plurality of fingers in an adjacent fixture in the plurality of fixtures, each rebar in the plurality of rebars configured to be secured within the concave edges of the corner junctions of the plurality of fixtures;

disposing the cage assembly into the hole in the ground surface so the upper handle sections of the plurality of rebars remain above the ground surface, the neck sections of the plurality of rebars extend within the upper shaft cavity of the hole, and the lower bent sections of the plurality of rebars extend within the lower bell-shaped cavity;

rotating the upper handle sections of the plurality of rebars to permit the lower bent sections of the plurality of rebars to extend outward into space within the bell-shaped cavity of the hole; and disposing concrete into the upper shaft cavity and lower bell-shaped cavity of the hole.

6. The method of claim 5, further comprising maneuvering the cage assembly so the lower bent sections of the plurality of rebars do not contact the bottom of the bell-shaped cavity.

7. The method of claim 6, wherein each fixture in the plurality of fixtures in the cage assembly comprises a generally hexagonal-shaped sheet with a central opening, the central opening comprising an edge with a plurality of inner hooks, each rebar in the plurality of rebars configured to be secured within the inner hooks of the plurality of fixtures.

8. The method of claim 7, further comprising inserting a tube within the shaft cavity of the hole so the plurality of fingers of the plurality of fixtures contact the tube.

* * * * *